United States Patent [19]

Norris

[11] Patent Number: 4,636,025

[45] Date of Patent: Jan. 13, 1987

[54] UNIVERSAL BATTERY TERMINAL CONNECTOR

[76] Inventor: Robert W. Norris, 1845 State Rte. 303, Streetsboro, Ohio 44241

[21] Appl. No.: 828,219

[22] Filed: Feb. 10, 1986

[51] Int. Cl.[4] ..... H01R 11/26

[52] U.S. Cl. ..... 339/230 R; 339/224; 339/263 B

[58] Field of Search ..... 339/230, 224–229, 339/231–241, 263 B, 272, 154 R, 154 A

[56] References Cited

U.S. PATENT DOCUMENTS

| | | | |
|---|---|---|---|
| Re. 26,486 | 11/1968 | Haegert | 339/263 B |
| 3,407,382 | 10/1968 | Haegert | 339/230 R |
| 3,605,065 | 9/1971 | Shannon | 339/224 |
| 3,609,656 | 9/1971 | Breidegam, Jr. | 339/230 R |
| 3,739,322 | 6/1973 | Haegert | 339/230 R |
| 3,821,694 | 6/1974 | Gottlieb | 339/232 |
| 3,893,744 | 7/1975 | Parazinski | 339/230 R |
| 4,012,104 | 3/1977 | Wening | 339/230 R |

*Primary Examiner*—Gil Weidenfeld
*Assistant Examiner*—Paula Austin
*Attorney, Agent, or Firm*—Oldham, Oldham and Weber Co.

[57] ABSTRACT

Universal battery terminal connector for connecting either the top post battery terminal or a side post battery terminal to a battery cable. The connector is an elongated metal body having means for connection to a top post battery terminal, second means for connection to a side post battery terminal, and third means for receiving one end of a battery cable and providing an electrical connection therewith. The top post battery terminal connection is at one end, the side battery terminal connection is either at the other end or in the middle, and the battery cable connection is correspondingly in the middle or at the other end.

11 Claims, 7 Drawing Figures

UNIVERSAL BATTERY TERMINAL CONNECTOR

TECHNICAL FIELD

This invention relates to battery accessories and more particularly to a novel connector which can be used with either a top post battery or a side post battery to provide an electrical connection between the battery terminal and an electrical cable.

BACKGROUND ART

Battery terminals for automotive vehicle storage batteries fall into two categories: top post battery terminals and side battery terminals. Both types of terminals are in wide spread use in the United States, and the structure and dimensions of each type are standardized.

The conventional top post battery terminal is an upstanding, slightly frustoconical metal post. For connection to a top post battery terminal, the battery cable is provided at one end with a socket or clamp in the form of a C-shaped ring which encircles the battery post, with lugs having bolt holes extending from the ring.

The conventional side battery terminal comprises a threaded metal socket which receives a threaded metal plug. This screw threaded plug may be attached either directly to a battery cable or to a connector which is interposed between the battery terminal and the battery cable.

Both types of battery terminals have their advantages and disadvantages. Cable connectors for top post batteries tend to corrode rather quickly and often must be replaced. Corrosion of connectors is less of a problem in side post batteries. On the other hand, it is difficult to attach a conventional jump-start cable to a side post battery terminal. It is much easier to jump-start a battery having top post terminals.

The presence of different types of battery terminals and correspondingly different battery end cable structures has resulted in the appearance of various types of battery connectors and accessories on the market. It is frequently necessary to replace a top post battery with a battery having side post terminals or vice versa; such replacement sometimes takes place under emergency conditions. The repairman must have two basic types of connectors, commonly called "conversions", on hand to meet this problem. One type of connector or adapter permits connection between a top post battery and a battery cable having an end which is designed for connection to a side battery terminal. A connector of this type is shown and described in U.S. Pat. No. 3,609,656 to Breidegam, for example. The other basic type of conversion permits connection between a side battery terminal and a battery cable; a conversion of this type is shown and described for example in U.S. Pat. No. 3,821,694 to Gottlieb.

Other types of battery connectors are also known. For example, U.S. Pat. No. 1,108,883 to Bijur shows a connection between a top post terminal and a battery cable; this connection may be used for example, if the original battery terminal connection becomes too corroded for further use. Corrosion of this type is not uncommon. Another type of replacement connector for attachment of a battery cable to a top post battery terminal comprises a C-shaped socket with lugs having bolt holes, and a threaded socket and a plate removably secured thereto for clamping a bare wire end of a battery cable. A still further type of connector, for side post batteries, makes it easier to jump-start batteries of this type. Such a connector includes a threaded plug which screws into the side battery terminal socket, and a top post similar to those on top post batteries. It is much easier to attach a conventional jump-start cable to a top post battery terminal than to the side battery terminal, as is well known; this connector makes it much easier to jump-start a side terminal battery.

The necessity for several different types of connectors to meet different situations is a problem for the battery accessory manufacturer and the automobile repairman alike. The automobile repairman must have each of the above-noted types of accessories on hand to be properly prepared for whatever situation may arise. The manufacturer must have different manufacturing lines, each with its own set of dies to make the different connectors. Distributors and retailers of automotive accessories would have to have each type of connector in inventory, which of course adds to the cost.

There is a need for a single connector which can be used in any of the foregoing situations. The present connector fulfills that need.

DISCLOSURE OF INVENTION

It is an object of this invention to provide a single battery terminal connector which will fit either a top post battery terminal or a side post battery terminal.

A related object is to provide a single battery terminal connector which can be used in any of the above situations likely to be encountered by the automobile owner or repairman.

These and other objects are fulfilled by the connector of this invention. This connector is a universal battery terminal connector for connecting either a top post battery terminal or a side post battery terminal to a battery cable and comprises an elongated electrically conductive body having first means for connecting to a top post battery terminal, second means for connecting to a side post battery terminal, and third means for receiving one end of a battery cable and providing an electrical connection therewith.

BRIEF DESCRIPTION OF DRAWINGS

Figure 1:
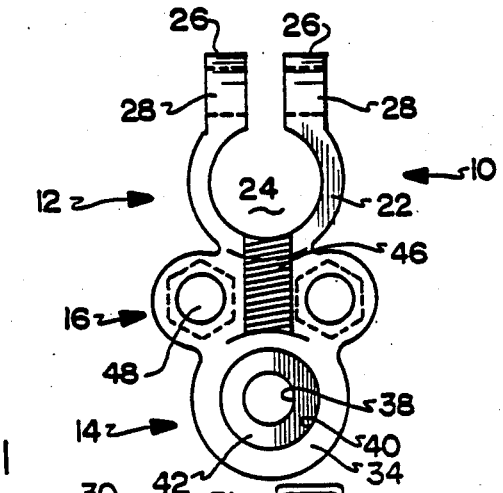

IN THE DRAWINGS:

FIG. 1 is a plan view of a battery terminal connector according to the first embodiment of this invention.

Figure 1A:
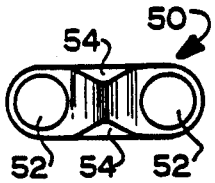

FIG. 1A is a top view of clamping plate used with the connector shown in FIG. 1.

Figure 2:
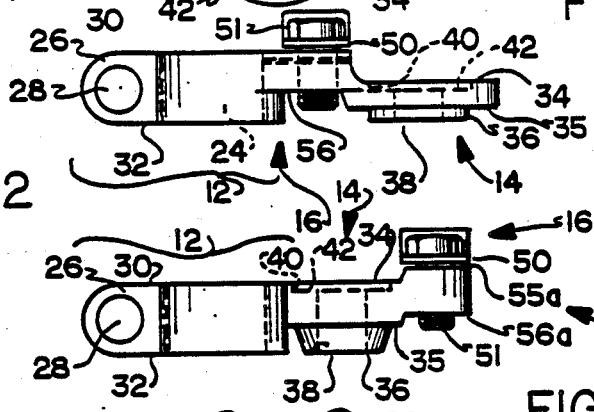

FIG. 2 is a side view of the battery terminal connector shown in FIG. 1.

Figure 3:
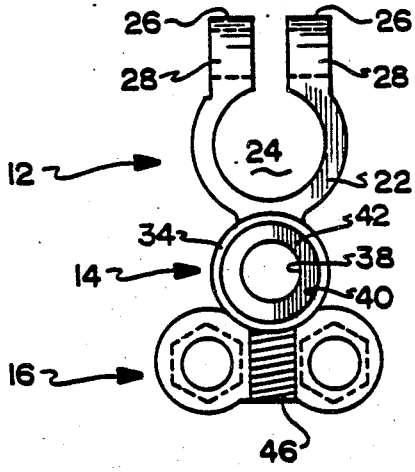

FIG. 3 is a plan view of a battery terminal connector according to a second embodiment of this invention.

Figure 4:
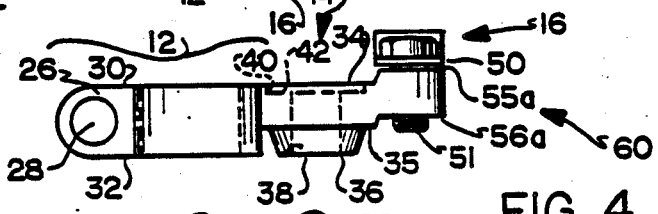

FIG. 4 is a side view of the battery terminal connector shown in FIG. 3.

Figure 5:
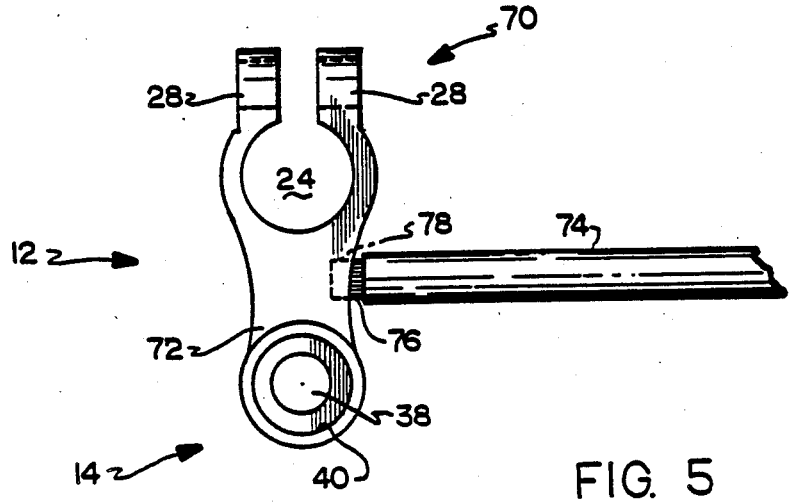

FIG. 5 is a plan view of a battery terminal connector according to a third embodiment of this invention.

Figure 6:
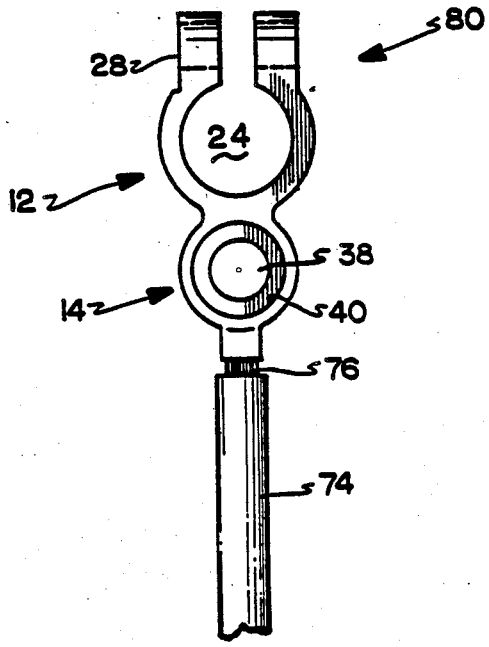

FIG. 6 is a plan view of a battery terminal connector according to a fourth embodiment of this invention.

BEST MODE FOR CARRYING OUT INVENTION

The first embodiment of this invention will now be described with reference to FIGS. 1, 1*a* and 2. Referring now to these figures, 10 indicates generally a universal battery terminal connector according to this first embodiment. Connector 10 is an elongated metal body, typically lead, which includes first means 12 for connection to a top post battery terminal, second means 14 for connection to a side post battery terminal and third means 16 for connection to a battery cable. First means 12 is located at one end of connector 10, second means 14 is at the other end, and third means 16 is in the middle. Third means 16 receives one end of the battery cable and provides an electrical connection between the cable and connector 10.

First means 12 for a connection to a top post battery terminal includes a hollow, thick-walled, generally cylindrical or (preferably) slightly tapered frustoconical C-shaped ring 22 which forms an opening 24 for a conventional top battery terminal post and a pair of longitudinally extending parallel lugs 26 which have bolt holes 28 therein. Ring 22 and lugs 26 together form a conventional clamp or female socket of the type commonly used on battery cable ends for connection with a conventional top post of a battery. The entire female socket or clamping member 12 has a single planar top surface 30 and a single planar bottom surface 32.

Second means 14 is a round, generally cylindrical member, much thinner than first means 14 and having a planar top surface 34 at a lower elevation than the top surface of socket 12, axially offset planar bottom surfaces 35 and 36, a bore 38 which extends through the entire thickness of member 14, and a counterbore 40 which extends downwardly only a small distance from the top surface 34 forming a shallow recess 42 in top surface 34. Surface 36 is in the form of a ring which protrudes just slightly below surface 35. Bore 38 is just slightly larger in diameter than the standard threaded socket of a side post battery terminal. Bore 38 and recess 42 receive the threaded portion and the head, respectively, of a bolt which is received in the side post battery terminal for the purpose of making an electrical connection.

Surfaces 32 and 36 may be coplanar as shown. Alternatively, the planes of surfaces 32 and 36 may be at a slight angle (say 5°) with respect to each other, each plane sloping slightly downwardly toward the center portion of connector 10. Either of these arrangements makes it possible to connect battery terminal connector 10 to either a top post battery or a side post battery. If either surface 32 or surface 36 projects beyond the other, such connection is not possible.

The third means 16 for receiving one end of a battery cable and providing an electrical connection therewith is a generally laterally extending member which comprises an essentially semicircular, screw threaded recess 46 which extends longitudinally along the central axis of the connector 10 and a pair of bolt holes 48 on either side of recess 46. Recess 46 receives a bare bundle of wires at one end of a conventional battery cable (not shown). A thin, essentially flat clamping plate 50 shown in FIG. 1A, is bolted to this third means 16 by means of a pair of bolts 51 in order to hold the wire bundle in place. Clamping plate 50 has a pair of bolt holes 52 which are the same distance apart as bolt holes 48, and is flat except for two slightly raised portions 54 which are located midway between the bolt holes 52 and which extend inwardly a slight distance from the side edges of the plate 50. These raised portions 54 are for the purpose of permitting the wire bundle to spread slightly near the lateral edge of plate 50 and to enable the central portion of plate 50 to firmly clamp the wire bundle. The structure of plate 50 is conventional in present battery accessories for the purpose of connecting a battery cable via a bare wire bundle to a top post terminal of a battery.

Battery cable connecting means 16 is thinner than the top post connecting means 12. The top surface of battery cable connecting means 16 is coplanar with top surface 30 of the top post connecting means 12, but the bottom surface 56 of the battery cable connecting means 16 is higher than the bottom surface 32 of top post connecting means 12.

A replacement connector having a socket member similar first means 12 for connection to a top post battery terminal, and a structure similar to third means 16 for connection to a battery cable at the other end, but lacking any counterpart of second means 14, is known in the art.

FIGS. 3 and 4 illustrate a universal battery terminal connector 60 according to a second embodiment of this invention. The second embodiment 60 is basically like the first, except that the parts are arranged in somewhat different order. First means 12 for receiving a top post battery terminal is identical to its counterpart in FIGS. 1 and 2 and needs no further description.

The second means 14 for a connection to a side post battery terminal is similar to its counterpart in FIG. 1, but is placed in the middle of connector 60, next to first means 12. Top surface 34 of this second portion is coplanar with top surface 30 of the clamp 12 and the bottom surface 36 of this second portion is coplanar with the bottom surface 32 of clamp 12.

The third means 16 for connecting a battery terminal is at the end of connector 60 which is remote from clamp 12.

Third portion 16 is generally similar to its counterpart in the embodiment of FIG. 1, except that the top plane surface **55*a* thereof is a slightly higher elevation than the top plane surfaces 30 and 34 of first and second portions 12 and 14, respectively. Portion 16 also has a planar lower surface 56*a*. A clamping plate 50 may be secured to connector 60 by means of a bolt 51 in a manner described in connection with the embodiment of FIG. 1**.

FIG. 5 illustrates a third embodiment of this invention, in which a connector and a battery cable are formed as a unitary structure. Referring now to FIG. 5, connector 70 comprises first means 12 for connection to a top post battery terminal, and second means 14 for connection to a side post battery terminal. Means 12 and 14 are like their counterparts in the embodiment of FIG. 1. Between first means 12 and second means 14 is a metal web 72 which is integral with both the first means 12 and the second means 14. The top surfaces of all three portions 12, 14 and 72 of this embodiment may lie in a common plane; similarly the bottom surfaces of all three portions may likewise lie in a common plane. This third embodiment 70 also includes a battery cable 74 having a short exposed wire bundle 76 at one end thereof. A recess 78 in web 72 receives the end of wire bundle 76. This wire bundle is integrally connected, for example, by welding or brazing to web 72, so that the connector and the battery cable in this embodiment form a unitary structure.

A fourth embodiment of the present invention is shown in FIG. 6. Referring now to FIG. 6, 80 designates a universal battery terminal connector according to this fourth embodiment. This embodiment includes a first portion 12 which forms first means for connection to a top post battery terminal, and a second portion 14 which forms second means for connection to a side battery terminal. These two portions are next to each other, as in the embodiments shown in FIGS. 3 and 4. A socket 82 in axial alignment with the center axis of connector 80 receives the end of exposed wire bundle 26 of battery cable 74. The battery cable 74 is integrally joined to the second portion 14 of connector 80 by welding, brazing or the like, so as to form a unitary structure. Cable 74 (or more precisely the portion thereof which is adjacent to the portion 14 of connector 80) is coaxial with connector 80.

Connectors 10 and 60 according to the first two embodiments of this invention may be used in similar manner for a variety of situations which may confront the automobile owner or repairman. In all of these illustrations, the connector is used as a replacement part, which is the principal use of the connectors of this invention. The description of uses will be with respect to connector 10 in FIGS. 1 and 2; connector 60 of FIGS. 3 and 4 may be used in the same way.

Suppose that a car owner must replace a top post battery with a battery having side terminals. First, he disconnects the battery cable (which conventionally has a socket fitting similar in shape to socket 12) from the battery post. Second, he secures the connector 10 to the new battery via a bolt which fits the threaded socket in the battery. This bolt extends through bore 38. Third, he removes the socket fitting from the battery cable, leaving a short length of bare wire. Fourth, he inserts this bare wire into recess 46 and secures the wire to the connector 10 with plate 50.

Suppose next that the automobile owner or repairman wishes to replace a side post battery with a top post battery. First, he disconnects the battery cable from the side battery terminal. He attaches a connector 10 (or 60) to the top post of a battery via socket 12. Third, he attaches the end of the battery cable (assuming the end includes a bolt which fits inside a conventional side battery terminal) to connector 10 or 60 by passing the bolt through bore 40 inside terminal connection means 14. Alternatively, he may remove the fitting at the end of the battery cable, leaving bare wire exposed, and insert this bare wire into battery cable-receiving portion 16 of the connector.

Now suppose that the conventional socket fitting at the end of a battery cable, for connection of the cable to a top post of a battery has become corroded. This fitting is removed, a connector 10 or 60 according to this invention is secured to the battery post and the bare wire bundle at the end of the battery cable is inserted into the battery cable connection portion 16 of the connector 10 or 60.

Finally, suppose that the fitting on a battery cable for connection to a side terminal battery has become corroded. The fitting is removed, connector 10 or 60 is secured to the battery by means of a bolt which passes through opening 40, and the bare wire bundle at the end of the cable is secured to the connector via a portion 16 thereof.

The embodiments shown in FIGS. 5 and 6 are easier to use than the embodiments of FIGS. 1 through 4; they result in considerable savings in time and labor. Thus, for example, suppose that the fitting at the end of a battery cable for connection to a top post battery has become corroded, one simply discards the entire battery cable, including the corroded fitting, and supplies a new connector 70 or 80, attaching the connector to the top post via socket 12. Similarly, when one replaces a side terminal battery with a top post battery, one simply discards the battery cable and supplies a new connector 70 or 80 according to this invention, attaching it to the top post via socket 12.

Replacement of a top post battery with a side post battery is also made easy. One simply discards the old battery cable and supplies a new connector 70 or 80, with its associated battery cable, attaching the connector to the side post terminal by means of a bolt which extends through opening 40 of portion 14.

Finally, if one simply wishes to provide a good contact surface for attaching jumper cables to a side battery terminal, the connector according to any of the embodiments of this invention fulfills this need. A connector according to the first or second embodiment of this invention is preferred when the battery cable does not need to be replaced. One simply disconnects the battery cable from the battery terminal, inserts a connector 10 or 60 in place, and reinserts the bolt at the end of the battery cable through opening 38 into the socket in the side of the battery.

It will be apparent from the foregoing description that the universal battery terminal connector according to any of the embodiments of this invention fulfills the need for a single part which can be used in any of the common situations which may confront the automobile owner or repairman. This makes it unnecessary for the auto repairman or supplier of auto parts to stock a variety of battery connectors, and instead makes it possible to stock only one type of connector which will satisfy every need. This has the obvious advantages of reducing the cost of inventory and of assuring that the repairman or supplier will always have on hand a connector which will fulfill any need which may arise.

While in accordance with the patent statutes, a preferred embodiment and best mode has been presented, the scope of the invention is not limited thereto, but rather is measured by the scope of the attached claims.

What is claimed is:

1. A universal battery terminal connector for connecting either a top post battery terminal or a side post battery terminal to a battery cable, said connector comprising an elongated electrically conductive body having:

(a) first means for connection to a top post battery terminal;

(b) second means for connection to a side post battery terminal, and (c) third means for receiving one end of a battery cable and providing an electrical connection therewith.

2. A connector according to claim 1 in which said first means comprises an essentially cylindrical or frustoconical clamping ring which is adapted to encircle a top post battery terminal and to provide a socket therefor.

3. A connector according to claim 1 in which said third means comprises a laterally extending portion having bolt holes near the ends thereof and a screw threaded recess between said bolt holes for receiving a wire bundle.

4. A connector according to claim 1 in which said first means and said second means are at opposite ends of said elongated body and said third means is between said first and second means.

5. A connector according to claim 1 in which said first means and said third means are at opposite ends of said elongated body and said second means is between said first and third means.

6. A connector according to claim 1 in which said second means comprises a round disk having a central opening therethrough, said central opening being large enough to receive a bolt of the diameter for connection to a side battery terminal.

7. A connector according to claim 6 in which said round disk comprises a bore forming said central opening and a counterbore forming inner and outer rings integrally joined together.

8. A connector according to claim 1 including a length of battery cable permanently attached thereto.

9. A connector according to claim 8 in which said length of battery cable includes a bundle of bare wire at an end thereof, said bare wire being joined to said elongated body by fusion.

10. A connector according to claim 9 in which said bare wire is joined to one end of said elongated body.

11. A connector according to claim 9 in which said bare wire is joined to the mid-portion of said elongated body.

* * * * *